US005249323A

United States Patent [19]

Kikuchi et al.

[11] Patent Number: 5,249,323

[45] Date of Patent: Oct. 5, 1993

[54] METHOD OF FABRIC-TO-FABRIC BONDING AND SEAMLESS QUILT FORMED THEREBY

[75] Inventors: Hiromichi Kikuchi; Yoshinori Hideshima, both of Yokohama; Keisuke Tanji, Fukushima, all of Japan

[73] Assignee: Asami Corporation, Yokohama, Japan

[21] Appl. No.: 913,145

[22] Filed: Jul. 14, 1992

[30] Foreign Application Priority Data

Aug. 9, 1991 [JP] Japan ..... 3-225169

[51] Int. Cl.[5] ..... A47G 9/00; B32B 7/08

[52] U.S. Cl. ..... 5/502; 112/440; 156/93

[58] Field of Search ..... 5/413, 457, 458, 500, 5/502; 156/92, 93; 112/440

[56] References Cited

U.S. PATENT DOCUMENTS

| | | | |
|---|---|---|---|
| 818,321 | 4/1906 | Whall | 5/457 |
| 1,706,560 | 3/1929 | Carlson | 5/458 |
| 2,637,860 | 5/1953 | Lehigh | 5/502 |
| 3,635,785 | 1/1972 | Hughes | 5/502 X |
| 3,755,057 | 8/1973 | Scott | 156/93 X |
| 3,790,975 | 2/1974 | Philipp et al. | 5/457 |
| 3,954,074 | 5/1976 | Wildeman | 112/440 X |
| 4,137,352 | 1/1979 | Stonebridge | 112/440 X |
| 4,328,599 | 5/1982 | Mollura | 5/458 X |
| 4,823,417 | 4/1989 | Fukuichi | 5/458 X |
| 5,003,902 | 4/1991 | Benstock et al. | 112/440 X |

FOREIGN PATENT DOCUMENTS

| | | | |
|---|---|---|---|
| 347953 | 7/1960 | Switzerland | 5/502 |
| 02254 | 10/1980 | World Int. Prop. O. | 112/440 |

*Primary Examiner*—Peter M. Cuomo
*Assistant Examiner*—Michael Milano
*Attorney, Agent, or Firm*—Bucknam and Archer

[57] ABSTRACT

A method of bonding fabric materials together into an integral structure is unique in the attachment of a mating fabric onto a base fabric. The mating fabric is disposed to have a longitudinal binding end of specified profile for adhesion to the base fabric with improved tensile strength. Also disclosed is a structurally durable seamless quilt obtained by the use of the method.

2 Claims, 5 Drawing Sheets

METHOD OF FABRIC-TO-FABRIC BONDING AND SEAMLESS QUILT FORMED THEREBY

BACKGROUND OF THE INVENTION

1. Technical Field

This invention relates to a method of bonding fabric materials together into an integral structure, which method is suitable particularly for use in the production of quilts and garments. Further, the invention is directed to a seamless quilt formed by the use of such method.

2. Prior Art

Sewing is a long-lasting practice in the formation of quilts, garments and many different articles. For instance, a quilt also called a bedspread has been fabricated with top and bottom sheets sewn in the form of a bag and a soft padding filled and kept in place in the bag by patterned stitchings adapted to run piercingly alternately through an outer surface of each of the two sheets.

Fabric-to-fabric bonding is beginning to take the place of sewing among quilt or apparel manufactureres. One typical method of bonding fabrics together is illustrated in FIGS. 5A to 5C of the accompanying drawings. As shown in FIG. 5A, a fabric sheet 10 is folded at its one longitudinal edge 10*a* back thereon and bonded thereat with use of a thermoplastic or thermosetting adhesive agent 16 commonly known in the art. FIG. 5B depicts adhesive joining of two similar or different fabrics using the agent 16, one base fabric 11 having bonded thereto one lengthwise end 12*a* of another mating fabric 12. A modified mode of bonding is viewed in FIG. 5C in which a fabric 13 is coated or dipped with the adhesive 16, thereby providing a bond line 14 for subsequent attachment to a companion fabric. To prevent dust deposition and hence insufficient adhesion, the bond line 14 is usually masked with a protective strip 15 such as a releasable paper. Bonding is finished, in each such instance, on a heated iron or a thermal press in common use.

The foregoing method of fabric-to-fabric bonding is of advantage as it is easy to perform without need for mechanical skill as is with a sewing machine and moreover capable of producing aesthetic seamless fabric articles. Such bonding method is desirable for quilt fabrication in particular since the ultimate product is obtainable without stitching holes over the outer surface thereof as against a sewn type of quilt. This will preclude the tendency of ticks or other insects to get intruded in the quilt, giving a strong impact to a hygienic sense of the user. Further advantageously, the user is immune from an itchy or offensive touch which is inherent to the sewn quilt and which is due to the tips of a feathery filler present in the quilt being liable to protrude out of the stitching holes.

A certain quilt of a seamless type is known as shown at 20 in FIGS. 6A and 6B. The quilt 20 has a quilt body 21 of a hollow, generally rectangular configuration including a top sheet 22 and a bottom sheet 23 held in bonded relation to each other along their peripheral edges. A plurality of partition walls 24 of a given fabric and a given dimension are arranged, in lattice fashion, to extend throughout the lengthwise and widthwise directions of the quilt body 21. By this arrangement, a multiplicity of compartments 26 are disposed in the quilt body 21 as seen at from 26*a* to 26*x* in FIG. 6B. Designated at 27 is a mass of a feathery filler loaded in each of the compartments 26 in a manner described hereinafter.

Each of the partition walls 24 is made up of two separate identical segments 24*a*, 24*c* adapted to be eventually interconnected together. The segment 24*a* has a binding end 24*b*, and the segment 24*c* has a similar binding end 24*d*, both binding ends being located opposite to each other and further pretreated with an adhesive agent 25 and masked with a protecting strip (not shown). The adhesive and strip used here are substantially the same characters described above in connection with the method of FIG. 5C.

In assembly, the partition segment 24*a* after being unmasked at the binding end 24*b* is adhesively attached onto an inner side of the top sheet 22 with the binding end 24*b* bent in an L shape, whereas the corresponding segment 24*c* is likewise united at the binding end 24*d* to an inner side of the bottom sheet 23. Bonding is completed by ironing or pressing with heat as stated above. The partition segments 24*a*, 24*c* in pair are thereafter connected at their free adjacent ends by a line of stitching 28 laid to run along the overall length of the partition wall 24. This procedure of assembly is repeated to form the partition wall 24 with a predetermined number of arrays and in two directions crosswise with the quilt body 21.

The top and bottom sheets 22, 23 once coupled together via the partition walls 24 are brought into adhesive contact with each other along the longitudinal and transverse edges thereof. At this stage of fabrication, one transverse edge of the quilt body 21 is held partly open for entry of the filler 27 as viewed at 29 on the left hand of FIG. 6A. Into each of the compartments 26 is successively blown the filler 27 in a given quantity on a padding device and through a selected compartment 26*a* positioned at the open edge 29 of the quilt body 21. Upon completion of the filler loading, the top and bottom sheets 22, 23 are superimposed one on the other at the open edge 29 and then sealed with an elongate adhesive fabric tape 30.

The above seamless quilt of the prior art, however, has a drawback in that it suffers structurally mechanical weakness. When subjected to considerable pulling forces in a direction perpendicular to the top or bottom sheet, this quilt tends to cause locally biased stresses at the regions where the partition walls have been bonded to that sheet, eventually leading to objectionable interlaminar separation and reduced service life.

SUMMARY OF THE INVENTION

The present invention has for its primary object to provide a method of bonding fabrics together which ensures improved strength of attachment and hence enhanced resistance to delamination even under stressed conditions.

Another object of the invention is to provide a seamless quilt which is easily producible by the use of the above method and highly satisfactory in regard to tensile strength and service life.

Many other features and advantages of the invention will be better understood from the following description taken in conjunction with the accompanying drawings.

In one important aspect, the invention provides a method of bonding fabric materials together into an integral structure which comprises: preparing a first or base fabric and a second or mating fabric, the second fabric having along its one longitudinal edge portion a binding end; mounting onto the binding end of the second fabric a reinforcing strip of a fabric material equal in length to but larger in width than the binding end, and uniting the binding end with the reinforcing strip by a stitching line running substantially centrally of the reinforcing strip, the reinforcing strip having been treated on its one side with an adhesive coating; and bringing the reinforcing strip on the coated side into adhesive contact with the first fabric, and subjecting the same to press finishing with heat.

The invention also provides a method of bonding fabric materials together into an integral structure which comprises: preparing a first or base fabric and a second or mating fabric, the second fabric having along its one longitudinal edge portion a binding end, the binding end being formed such that the second fabric is folded at one end thereon and interconnected together thereat by a stitching line to thereby provide a double-layered half and a single-layered half about the stitching line, the double-and single-layered halves having been treated on their respective one sides with an adhesive coating; and bringing both halves on the coated sides into adhesive contact with the first fabric, and subjecting the same to press finishing with heat.

The invention further provides a method of bonding fabric materials together into an integral structure which comprises: preparing a first or base fabric and a second or mating fabric, the second fabric having along its one longitudinal edge portion a binding end, the binding end being formed such that the second fabric is folded at one end back thereon and interconnected together at three different locations by a stitching line to thereby provide two double-layered arms and one double-layered leg located centrally upwardly therebetween, the double-layered arms being sewn respectively contiguous to the double-layered leg and having been treated on their respective one sides with an adhesive coating; and bringing the double-layered arms on the coated sides into adhesive contact with the first fabric, and subjecting the same to press finishing with heat.

In another aspect, the invention provides a seamless quilt comprising: a quilt body of a hollow, generally rectangular configuration including a top sheet and a bottom sheet held in bonded relation to each other along their peripheral edges; a plurality of arrays of partition walls of a fabric material and a predetermined dimension being oriented in a lattice posture such that the partition walls extend throughout the entire length and width of the quilt body to thereby dispose a multiplicity of compartments in the quilt body, each of the partition walls being made up of two separate, upper and lower, segments provided respectively with opposite binding ends and adjacent free ends, each of the binding ends having a reinforcing strip of a fabric material made equal in length to but larger in width than the binding end and united together by a stitching line laid to run substantially centrally of the reinforcing strip, the reinforcing strip having been treated on its one side with an adhesive coating, one of the reinforcing strips being attached on the coated side onto an inner surface of the top sheet and the other onto an inner surface of the bottom sheet and thereafter subjected to press finishing with heat, the two segments of the partition wall being subsequently sewn together at the free ends; and a mass of padding loaded in each of the compartments.

The invention also provides a seamless quilt comprising: a quilt body of a hollow, generally rectangular configuration including a top sheet and a bottom sheet held in bonded relation to each other along their peripheral edges; a plurality of arrays of partition walls of a fabric material and a predetermined dimension being oriented in a lattice posture such that the partition walls extend throughout the entire length and width of the quilt body to thereby dispose a multiplicity of compartments in the quilt body, each of the partition walls being made up of two separate, upper and lower, segments provided respectively with opposite binding ends and adjacent free ends, each of the binding ends being formed in such a manner that each of the segments is folded at one end thereon and interconnected together thereat by a stitching line, thereby providing a double-layered half and a single-layered half about the stitching line, the double- and single-layered halves having been treated on their respective one sides with an adhesive coating, one of the upper binding ends on the upper segment being attached on the coated side onto an inner surface of the top sheet and the other on the lower binding end onto an inner surface of the bottom sheet and thereafter subjected to press finishing with heat, the two segments of the partition wall being subsequently sewn together at the free ends; and a mass of padding loaded in each of the compartments.

The invention further provides a seamless quilt comprising: a quilt body of a hollow, generally rectangular configuration including a top sheet and a bottom sheet held in bonded relation to each other along their peripheral edges; a plurality of arrays of partition walls of a fabric material and a predetermined dimension being oriented in a lattice posture such that the partition walls extend throughout the entire length and width of the quilt body to thereby dispose a multiplicity of compartments in the quilt body, each of the partition walls being made up of two separate, upper and lower, segments provided respectively with opposite binding ends and adjacent free ends, each of the binding ends being formed in such a manner that each of the segments is folded at one end back thereon and interconnected together at three different locations by a stitching line, thereby providing two double-layered arms and one double-layered leg located centrally upwardly therebetween, the double-layered arms being sewn respectively contiguous to the double-layered leg and having been treated on their respective one sides with an adhesive coating, one of the upper binding ends on the upper segment being attached on the coated side onto an inner surface of the top sheet and the other on the lower segment onto an inner surface of the bottom sheet and thereafter subjected to press finishing with heat, the two segments of the partition wall being subsequently sewn together at the free ends; and a mass of padding loaded in each of the compartments.

DETAILED DESCRIPTION OF THE INVENTION

Figure 1A:
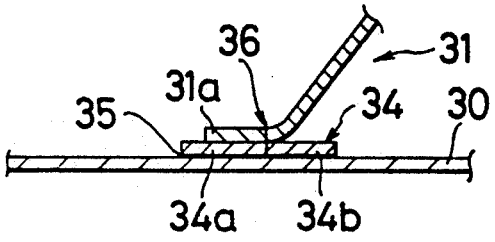
FIGS. 1A to 1C are side elevations showing three preferred embodiments of the fabric-to-fabric bonding method embodying the present invention.
Figure 1B:
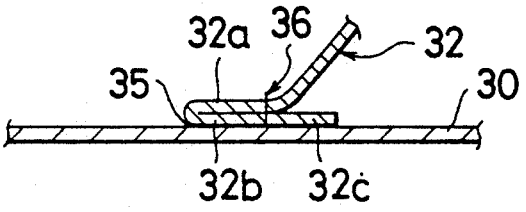
Figure 1C:
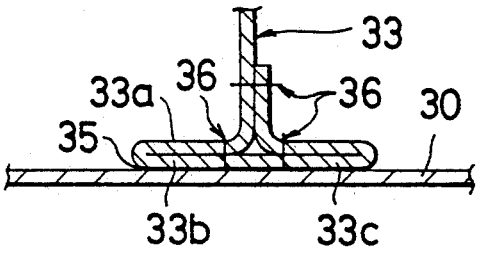

Referring now to the drawings and FIGS. 1A to 1C in particular, there are shown three embodiments of a fabric-to-fabric bonding method contemplated under the present invention.

Figure 2:
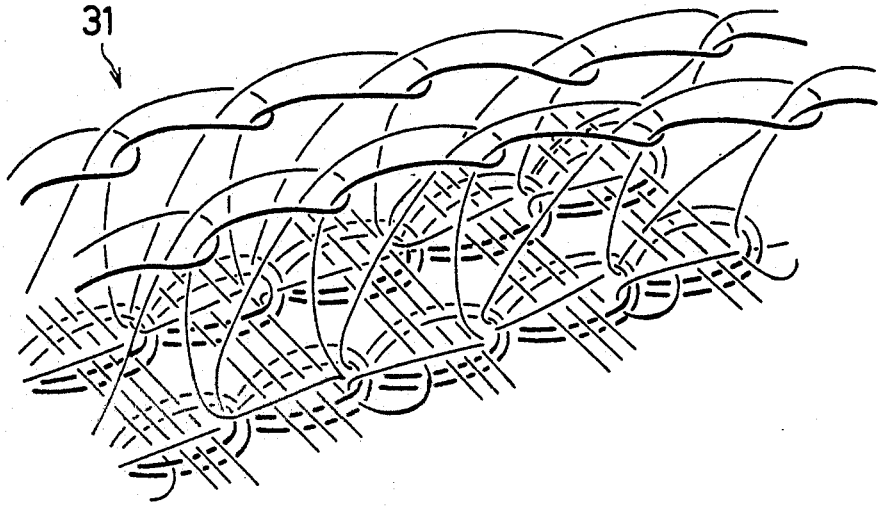
FIG. 2 is a perspective view on enlarged scale of a knit structure of a mating fabric to be bonded to a base fabric in the method of FIGS. 1A to 1C.

FIG. 1A illustrates a first embodiment of the method according to the invention in which a first or base fabric 30 has bonded thereto a second or mating fabric 31 at a binding end 31*a* thereof, the mating fabric 31 extending substantially along the entire length of the base fabric 30. Between the base fabric 30 and the binding end 31*a* is interposed a reinforcing strip 34 which is formed of a given fabric and made equal in length to but larger in width than the binding end 31*a*. Fabric materials to be used for the mating fabric 31 are chosen from those preferably of synthetic fibers such as of polyamide, polyester and various other known polymers and typically of a knit structure such as a back-half tricot pattern as viewed in FIG. 2. Such a knit fabric is highly mechanically strong, fray-free and air-permeable. The reinforcement 34 may be of a non-woven fabric which is generally great in mechanical strength and easy in adhesive treatment. To implement the method of the invention, the reinforcement 34 may be conveniently pretreated on one side by coating with a commercially available adhesive 35 of for example a thermosetting class, followed by temporary protection with a releasable strip (not shown) commonly accepted in the art. The binding end 31*a* of the mating fabric 31 is mounted in place on an uncoated side of the reinforcement 34 and then coupled together by a stitching line 36. From the strength point of view, the stitch 36 may be positioned to run substantially centrally of the reinforcement 34 to thereby provide two halves 34*a*, 34*b*. This enables the mating fabric 31 to stand up at a midpoint of the reinforcement 34, thus preventing the base fabric 30 from becoming biasedly stressed even on exposure to intense pulling force. The mating fabric-carrying reinforcement 34 is subsequently unmasked on the coated side and attached onto the base fabric 30. Firm adhesion is attained in conventional manner as by ironing or pressing with heat.

A second embodiment of the method of the invention is represented in FIG. 1B in which a mating fabric 32 is folded at one end thereon and sewn together thereat, thereby defining a binding end 32*a*. The stitch 36 may be made to run centrally of the binding end 32*a* so that this latter binding end is provided with a double-layered half 32*b* and a single-layered half 32*c*. The binding end 32*a* may be adhesion-pretreated on one side over the halves 32*b*, 32*c* as in the reinforcement 34 of the first embodiment. The coated side of the binding end 32*a* of the mating fabric 32 is allowed to contact with the base fabric 30 and thereafter subjected to thermal press finishing.

According to a third embodiment of the method of the invention as depicted in FIG. 1C, a mating fabric 33 is folded at one end back thereon and shaped to be of an inverted letter of T, whereby a binding end 33*a* is formed with two double-layered arms 33*b*, 33*c* and one double-layered leg 33*d*. Stitching is done at 36 and at three locations, namely at the arms 33*b*, 33*c* and at the leg 33*d*. The arms 33*b*, 33*c* may be sewn as near to the leg 33*d* as possible. The mating fabric 33 is bonded at the binding arms 33*b*, 33*c* to the base fabric 30, which arms have been previously adhesion-treated as are in the first and second embodiments.

The second- and third-embodied mating fabrics 32, 33 are identical in nature to the first-embodied counterpart 31.

Sewing threads suitable as the stitch 36 are necessarily greater in the mechanical strength than in the adhesive strength attainable between the base fabric 30 and each of the mating fabrics 31 to 33. Hot-melt adhesion may be effected in place of stitching in the first embodiment when the mating fabric 31 and the reinforcing strip 34 are employed as being formed of thermally meltable materials. Hot melting is also useful in forming the binding ends 32*a*, 33*a* in the second and third embodiments.

With the method of the invention provided, it is made possible to fabricate a conspicuously durable fabric article. When the fabric article is exposed to intense forces tending to pull away the mating fabric out of the base fabric, such forces can be distributed over the base fabric without localization at the regions where both fabrics are held in bonded relation to each other. This is attributed to the unique structure of the mating fabric at its binding end tailored to exhibit high tensile strength by means of stitching. The fabric article according to the invention has now been found to have a tensile strength of from 17.1 to 18.3 kgf as determined by the Grab test with a 10-cm wide specimen, a 2.5-cm wide grip and a 10 cm/min elongation speed on a low-speed tensile tester. This magnitude of tensile strength is as high as about ten times that obtainable by the prior art method.

Figure 3A:
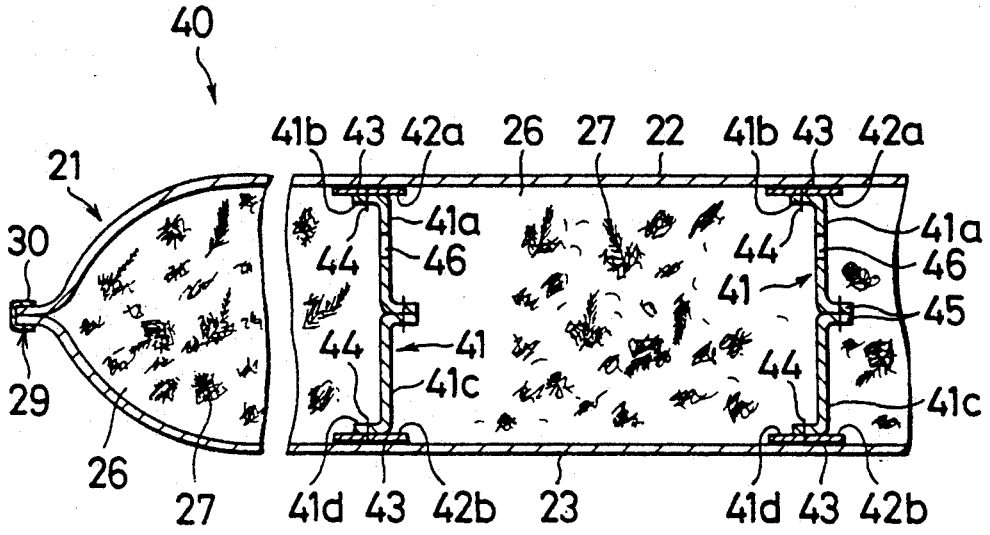
FIGS. 3A and 3B represent the seamless quilt of the invention, FIG. 3A being taken as a fragmentary side-elevational view and FIG. 3B as a schematic top view.
Figure 3B:
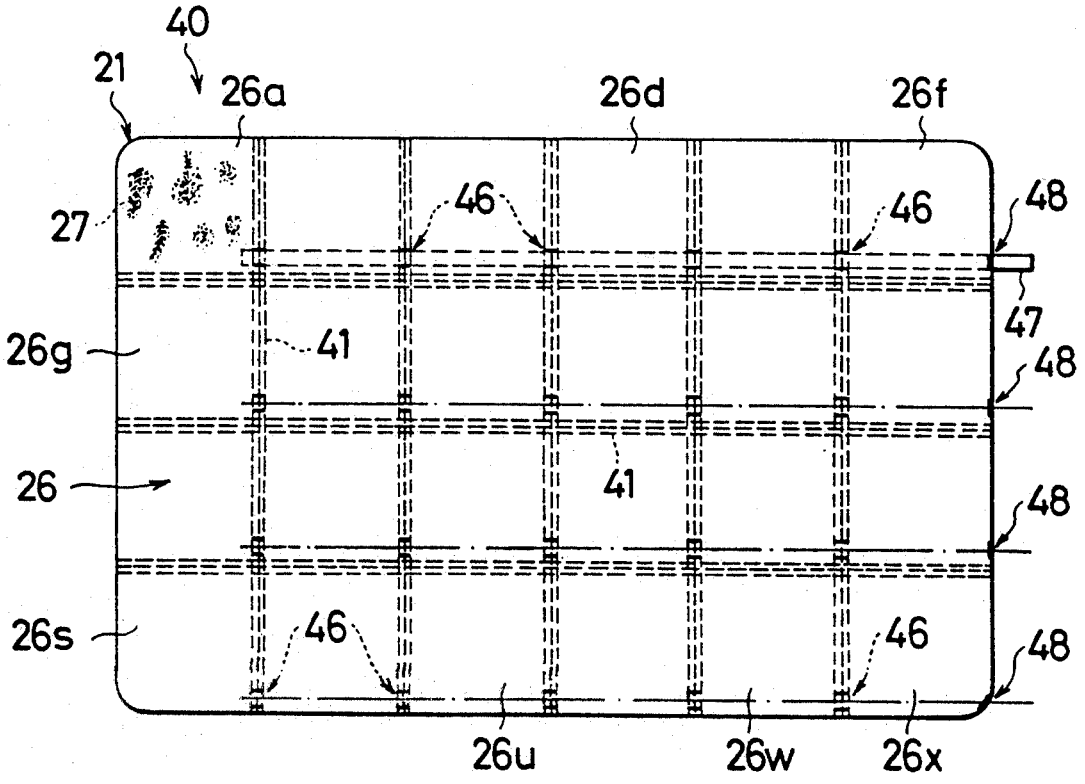

A seamless quilt constructed in accordance with the invention is shown at 40 in FIGS. 3A and 3B in which the method of FIG. 1A has been used for purposes of illustration. In general, the quilt 40 of the invention is structurally similar to the quilt 20 of the prior art. Details as regards the common structure and assembly of both quilts, therefore, will need no further description. Like numerals refer to like or corresponding parts throughout FIGS. 3A and 3B and FIGS. 6A and 6B.

One important feature of the quilt 40 according to the invention lies in the specific attachment of a plurality of partition walls 41 onto an inner surface of each of the top and bottom sheets 22, 23 in the quilt body 21. The two sheets 22, 23 may be made of fabric materials known in the quilt industry. The partition walls 41, derived from severing a selected fabric such as the mating fabric 31 of FIG. 1A into a given dimension, are oriented in a lattice posture to thereby make up the compartments 26 in the quilt body 21. Each of the partition walls 41 is constituted of two separate segments 41*a*, 41*c* provided respectively with opposite binding ends 41*b*, 41*d*. A reinforcing strip 42*a* is firmly fixed to the binding end 41*b* and a similar reinforcing end 42*b* to the binding end 41*d*, each by a stitch 44. These reinforcements each have been pretreated on one side with an adhesive coating 43 and protected on the coated side with a releasable strip (not shown). Such coating and protection may be conducted as are done in the method of FIG. 1A. The fabric material for, the stitching mode of and the adhesive treatment of the reinforcements 42*a*, 42*b* as well as the sewing thread for the stitch 44 are such stated above with reference to the method of FIG. 1A.

The reinforcing strips 42*a*, 42*b* supported respectively on the binding ends 41*b*, 41*d* of the partition wall 41 are exposed from external view on the coated sides, after which the reinforcement 42*a* is bonded in place to the inner surface of the top sheet 22 and the reinforcement 42*b* to the inner surface of the bottom sheet 23. The paired partition segments 41*a*, 41*c* are then united at their free or junction ends by a stitch 45 of for example the same mechanical strength as in the stitch 43 employed to couple the reinforcements 42*a*, 42*b* with the binding ends 41*b*, 41*d*. No particular restriction is imposed on the number of arrays of the partition walls 41 to be disposed in the quilt body 21. The order of orientation of the partition walls 41 is optional with respect to the longitudinal and transverse directions of the quilt body 21.

According to the quilt 40 of the invention, the partition segments 41*a* each bonded to the top sheet 22 have through apertures 46 held in aligned relation to one another as better seen in FIG. 3B. The apertures 46 are used to accommodate a leading pipe or conduit 47 connected with a padding device (not shown) when the filler 27 is loaded into each of the compartments 26. The apertures 46 may be disposed in each array of the partition walls 41 directed lengthwise or widthwise of the quilt body 21, but are illustrated as in the lengthwise arrays in FIG. 3B. In that instance, the apertures 46 are usually positioned contiguous to the corresponding lengthwise or widthwise arrays of the partition walls 41. Though not restrictive, the apertures 46 are generally spherical to fit the shape of the pipe 47.

In order for the pipe 47 to be inserted into the apertures 46 of the partition walls 41, the quilt body 21 according to the invention has partly unsealed portions 48 lying at a transverse edge opposite to the sealed edge 29 and communicating with the apertures 46 as viewed in FIG. 3B. The filler 27 is thus loaded in turn by blowing feathery material with compressed air through the pipe 47 and by beginning with for example the compartment 26*a* onward. This ensures efficient and uniform loading of the filler in each of the compartments 26. Subsequently, the quilt body 21 is adhesively sealed at the portions 48 with the fabric tape 30 so that a quilt product is provided.

When it is found desirable, cotton wool may be used as the filler 27. This type of pad is filled simultaneously with sewing of the paired segments 41*a*, 41*c* of the partition wall 41 in a preceding array and hence forming a first compartment in the quilt body 21. Segment sewing and cotton filling are alternately repeated to obtain a quilt product.

Figure 4:
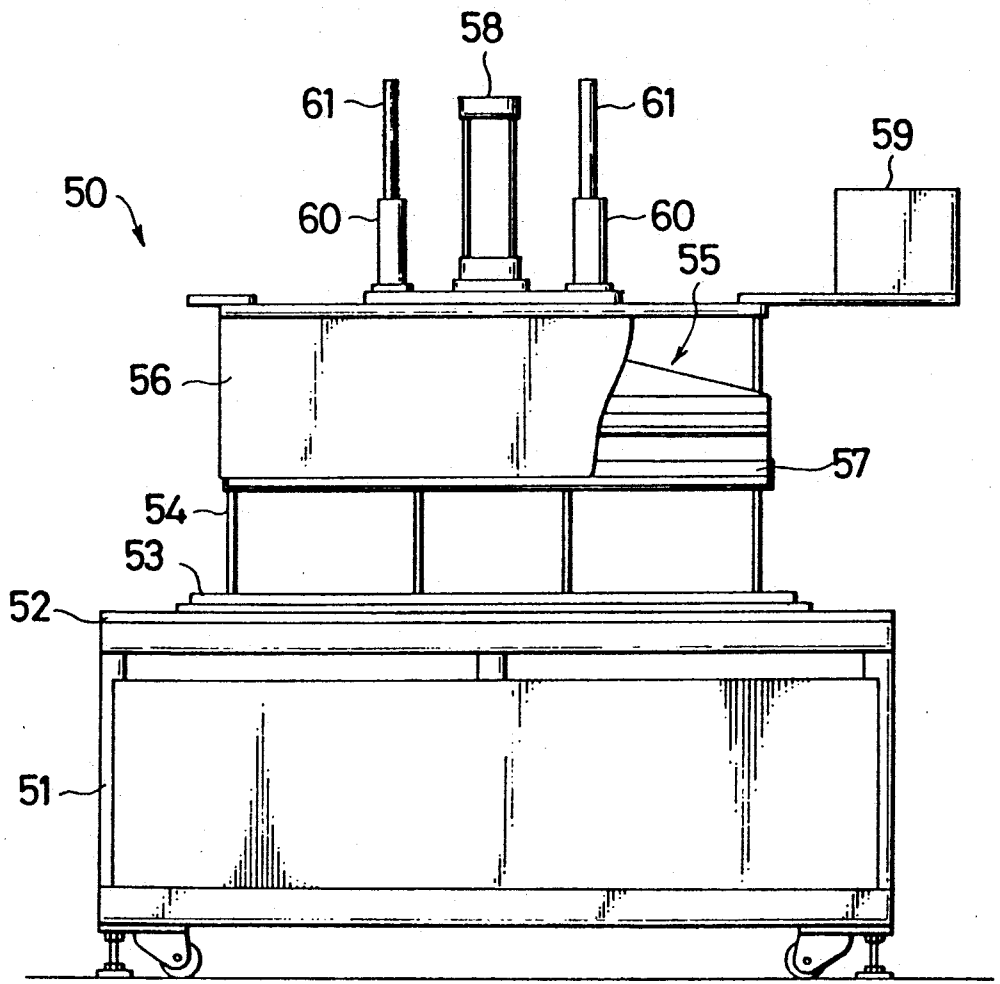
FIG. 4 is a schematic front elevation of a thermal press suitable for use in fabricating the quilt or the invention.
Figure 5A:
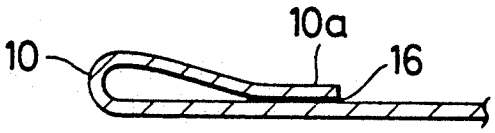
FIG. 5A PRIOR ART
FIGS. 5A to 5C are illustrative of the prior art method of bonding fabrics together, FIGS. 5A and 5B being views in cross section and FIG. 5C a view in perspective.
Figure 5B:
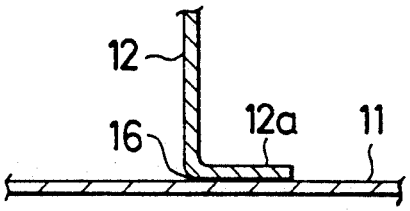
FIG. 5B PRIOR ART
Figure 5C:
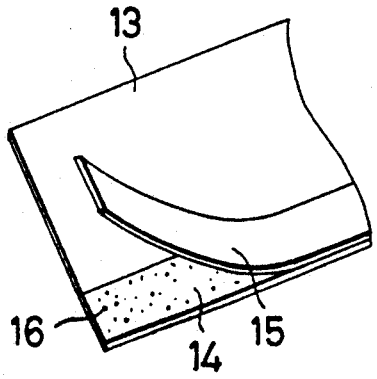
FIG. 5C PRIOR ART
Figure 6A:
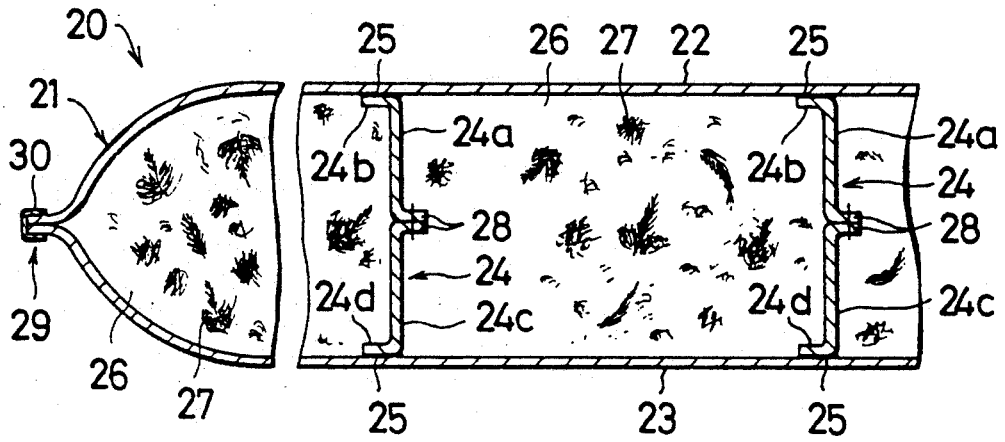
FIG. 6A PRIOR ART
FIGS. 6A and 6B are similar to FIGS. 3A and 3B but explanation of the prior art seamless quilt.
Figure 6B:
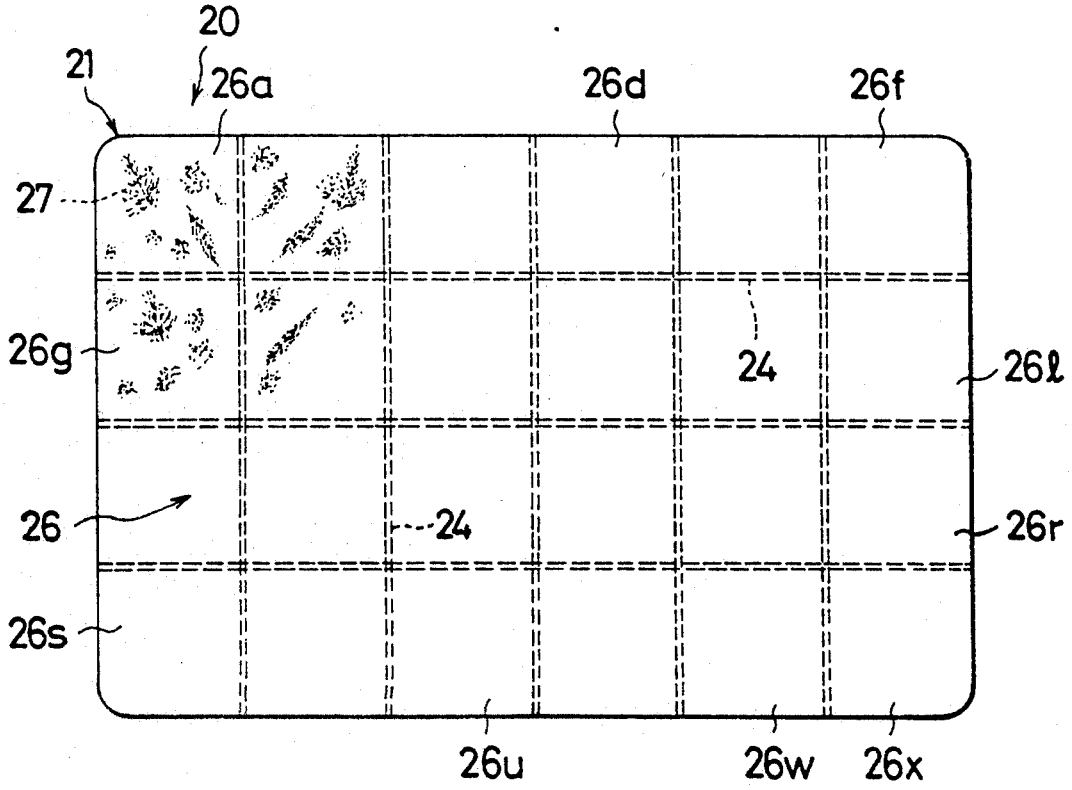
FIG. 6B PRIOR ART

Reference to FIG. 4 illustrates a thermal pressing device for use in fabricating the quilt of the invention. Such type of device is commonly known in the art and generally desired to be used to press and bond continuous sheets of fabrics together, namely the partition walls 41 to be adhesively attached onto the top and bottom sheets 22, 23 in the quilt 40 of the invention. This contributes to quilt production with uniform quality and manpower saving.

The above pressing device indicated at 50 in FIG. 4 is comprised of a stand 51, a plate member 52 mounted on the stand 51 and an elongate plate-like work station 53 placed stationarily on the plate 52. An arm member 54 is located rearwardly of the station 53 and made movable upwardly downwardly of the station 53. Connected to the arm 54 is a head member 55 which has a flat pressing portion including heat means 57 and reciprocates toward and apart from the station 53 so as to press and heat a fabric-to-fabric region to be bonded. The heat means 57 has a thermistor or a wire resistance as a heat source. An air cylinder 58 is disposed upwardly of the arm 54 for actuation of the head 55. Cylindrical guide means 60, 60 are arranged on the arm 54 to guide up-and-down movement of a pair of guiding rods 61, 61 mounted on the head 55. Designated at 59 is control means in which are included electromagnetic valves and relays and at 56 is a protective covering.

In operation, the segment 41*a* of the partition wall 41 is attached via the reinforcing strip 42*a* onto the top sheet 22 on the work station 53. The air cylinder 58 is then driven to move the head member 55 into an operative position in which the reinforcing strip 42*a* supported on the top sheet 22 is pressed in sandwiched relation between the pressing portion of the head 55 and the upper surface of the station 53. The adhesive coated over the reinforcing strip 42*a* is softened or molten during pressing as the heat means 57 is maintained at elevated temperature. Pressing and bonding are thus made possible in simultaneous relation. Subsequent actuation of the cylinder 58 retracts the head 55 into an inoperative position in which the latter moves upwardly of and apart from the station 53. The resulting fabric region bonded is naturally cooled with air. This mode of operation is repeated to press and bond the reinforcing strip 42*b* onto the bottom sheet 23. The segments 41*b*, 41*d* thus attached respectively onto the top and bottom sheets 22, 23 are sewn together at their free ends.

Although the quilt 40 of the invention has been shown and described as incorporating the specific structure according to the method of FIG. 1A, it is to be noted that the structural details of the method illustrated in each of FIGS. 1B and 1C may be applied to form a highly durable seamless quilt.

What is claimed is:

1. A method of bonding fabric materials together into an integrated structure which comprises:

(a) preparing a first or base fabric and a second or mating fabric, the second fabric having along its longitudinal edge portion a binding end;

(b) mounting onto said binding end of the second fabric a reinforcing strip of a fabric material equal in length to but larger in width than said binding end, and uniting said binding end with said reinforcing strip by a stitching line running substantially centrally of said reinforcing strip, said reinforcing strip having been treated on its one side with an adhesive coating; and (c) bringing said reinforcing strip on the coated side into adhesive contact with the first fabric, and subjecting the same to press finishing with heat.

2. A seamless quilt comprising:

(a) a quilt body of a hollow, generally rectangular configuration including a top sheet and a bottom sheet held in bonded relation to each other along their peripheral edges;

(b) a plurality of arrays of partition walls of a fabric material and a predetermined dimension being oriented in a lattice posture such that said partition walls extend throughout the entire length and width of the quilt body to thereby dispose a multiplicity of compartments in the quilt body, each of said partition walls being made up of two separate, upper and lower, segments provided respectively with opposite binding ends and adjacent free ends, each of said binding ends having a reinforcing strip of a fabric material made equal in length to but larger in width than said binding end and united together by a stitching line laid to run substantially centrally of said reinforcing strip, said reinforcing strip having been treated on its one side with an adhesive coating, one of said reinforcing strip on said upper segment being attached on the coated side onto an inner surface of the top sheet and the other on said lower segment onto an inner surface of the bottom sheet and thereafter subjected to press finishing with heat, said two segments of said partition wall being subsequently sewn together at the free ends; and (c) a mass of padding loaded in each of said compartments.

* * * * *

US005249323B1

REEXAMINATION CERTIFICATE (3467th)

United States Patent [19]

[11] B1 5,249,323

Kikuchi et al.

[45] Certificate Issued Mar. 17, 1998

[54] METHOD OF FABRIC-TO-FABRIC BONDING AND SEAMLESS QUILT FORMED THEREBY

[75] Inventors: Hiromichi Kikuchi; Yoshinori Hideshima, both of Yokohama; Keisuke Tanji, Fukushima, all of Japan

[73] Assignee: Asami Corporation, Yokohama, Japan

Reexamination Request:
No. 90/004,619, Apr. 29, 1997

Reexamination Certificate for:

| | |
|---|---|
| Patent No.: | **5,249,323** |
| Issued: | **Oct. 5, 1993** |
| Appl. No.: | **913,145** |
| Filed: | **Jul. 14, 1992** |

[30] Foreign Application Priority Data

Aug. 9, 1991 [JP] Japan ..... 3-225169

[51] Int. Cl.[6] ..... A47G 9/00; B32B 7/08

[52] U.S. Cl. ..... 5/502; 112/440; 56/93

[58] Field of Search ..... 5/413, 457, 458, 5/500, 502; 156/92, 93; 112/900

[56] References Cited

U.S. PATENT DOCUMENTS

| | | |
|---|---|---|
| 4,230,756 | 10/1980 | Hansen . |
| 4,520,054 | 5/1985 | Pfeiffer . |
| 4,908,895 | 3/1990 | Walker . |
| 5,031,260 | 7/1991 | LaBianco . |

*Primary Examiner*—Michael F. Trettel

[57] ABSTRACT

A method of bonding fabric materials together into an integral structure is unique in the attachment of a mating fabric onto a base fabric. The mating fabric is disposed to have a longitudinal binding end of specified profile for adhesion to the base fabric with improved tensile strength. Also disclosed is a structurally durable seamless quilt obtained by the use of the method.

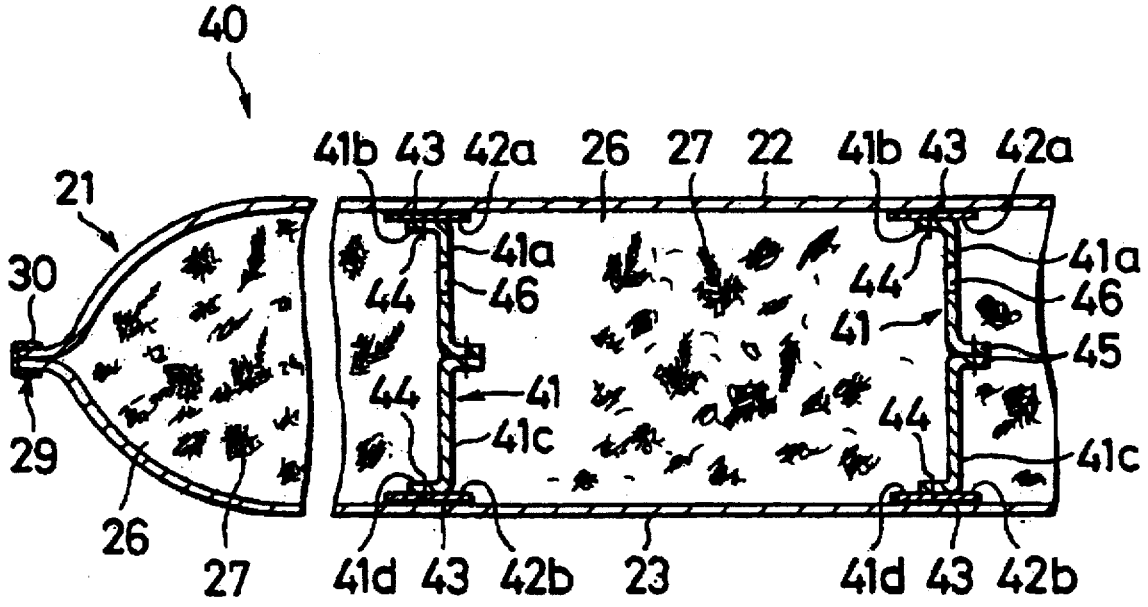

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1 and 2 are cancelled.

* * * * *